US005711717A

United States Patent [19]

Richards

[11] Patent Number: 5,711,717

[45] Date of Patent: Jan. 27, 1998

[54] GOLF SWING SIMULATION APPARATUS

[76] Inventor: Ralph Henry Arthur Richards, 20 Homestead Gardens, Frenchay, Bristol, BS16 1PH, United Kingdom

[21] Appl. No.: 603,414

[22] Filed: Feb. 20, 1996

[30] Foreign Application Priority Data

Feb. 21, 1995 [GB] United Kingdom ..... 9503388

[51] Int. Cl.[6] ..... A63B 69/36

[52] U.S. Cl. ..... 473/229

[58] Field of Search ..... 473/229

[56] References Cited

U.S. PATENT DOCUMENTS 2,737,432 3/1956 Jenks ..... 473/229

*Primary Examiner*—George J. Marlo

*Attorney, Agent, or Firm*—Pearne, Gordon, McCoy & Granger LLP

[57] ABSTRACT

Apparatus for guiding a simulated golf swing consists of a golf club handle fixed at one end of a mechanical linkage whose other end can be fixed to a wall. The handle is fixed, so as to be rotatable about its own axis, to a crank of the linkage. The crank is connected in turn to an elongate arm pivoted at the fixing location so as to guide a swing in a basic arc. A central pivot of the crank permits the user's wrists to flex during the swing.

The handle carries a projecting pointer which moves over an index plate fixed to the adjacent connector on the crank. The index plate has stop lugs to limit the rotation of the handle by abutting the turning pointer. A scale on the index plate enables a suitable address position to be selected. By thus controlling and indicating the handle's rotation it becomes possible to school the user's hand movements and thereby improve the alignment of the club face during the swing. (FIGS. 1 and 5)

17 Claims, 3 Drawing Sheets

GOLF SWING SIMULATION APPARATUS

BACKGROUND OF THE INVENTION

1. Field of the Invention

This invention concerns equipment for guiding a swinging movement to help practise a golf swing.

2. Prior Art

Golf swing simulators are known. Broadly, they comprise means for mounting the simulator device in fixed relation to some stationary support (usually a wall), a handle portion, and a mechanical swing-guiding linkage connecting the handle portion to the mounting means to guide a swinging movement of the handle portion relative to the mounting means in simulation of a golf swing, typically in a single plane.

GB-A-2039221 proposed a linkage having the handle portion connected to a crank on the end of an arm piloted to the mounting means. The swing of the arm around the mount provides the basic swing, while flexing of the user's wrists is accommodated by a pivot in the crank.

My GB-A-2081107 described adjustment mechanisms for the mount and linkage.

The present proposals are preferably implemented in the context of the linkages I proposed previously, but are not necessarily limited to that context since other forms of linkage may be possible.

In a guided swing the natural movement of a user's arms rotates the user's grip relative to the adjacent component of the guide mechanism as the swing proceeds. To accommodate this, the handle portion of the known simulator has been rotatable about its own longitudinal axis.

SUMMARY OF THE INVENTION

What I now propose is to include in the simulator a monitor arrangement responsive during the swing to the degree of rotation of the handle portion around its own longitudinal grip axis, and in particular capable of determining a degree of such rotation relative to the adjacent handle connector component of the linkage, by interaction with that connector component.

Some aspects of the invention are set out in the claims.

The monitoring arrangement may provide for mechanical engagement between these components, e.g. by respective radially overlapping or meshing members which can interact to determine the rotation. It may restrain or control the rotation, e.g. by providing one or more rotation limiters or stops. For example a radial projection on the handle portion may meet a stop abutment on the handle connector. Such a limiter/stop may be adjustable. Means may be provided for predetermining an angle between a predetermined start position and a stop position.

Additionally or alternatively the monitoring arrangement may record, gauge, measure, indicate or signal a degree of rotation occurring during the swing in a mode directly verifiable by the user, by means of interaction between the handle portion and the handle connector.

Any rotation sensor or indicator may serve; it may continuously determine the rotational orientation and/or determine a threshold value. It may any mechanical, electrical or optical interaction between the handle and connector.

For example either of the handle and connector components may have at least one index marker, graded scale or other positional indicator to show rotational alignment, e.g. by comparison with a marker on the other component.

The practical significance of this is as follows. Existing simulation mechanisms can school the swing into a plane, while accommodating those rotational grip movements required for a natural swing. But, I note that these movements are themselves important to a good swing. A swing that is both accurate and efficient requires the club head at impact to be travelling precisely along the target line with the club face leading edge square to that line. The condition of the club head face is dictated throughout the swing by the hands and it is essential when addressing the ball before commencing the swing that the hands are correctly set on the handle grip relative to the club head face. It is especially important that, at the top of the back swing, the condition of the hands (and consequently of the club head face) is correct relative to the swing plane to ensure that the leading edge of the club head face returns square to the swing path at impact.

My proposal therefore opens the way to schooling of these grip rotation movements within the context of a guided swing.

DETAILED DESCRIPTION OF PREFERRED EMBODIMENTS

Figure 1:
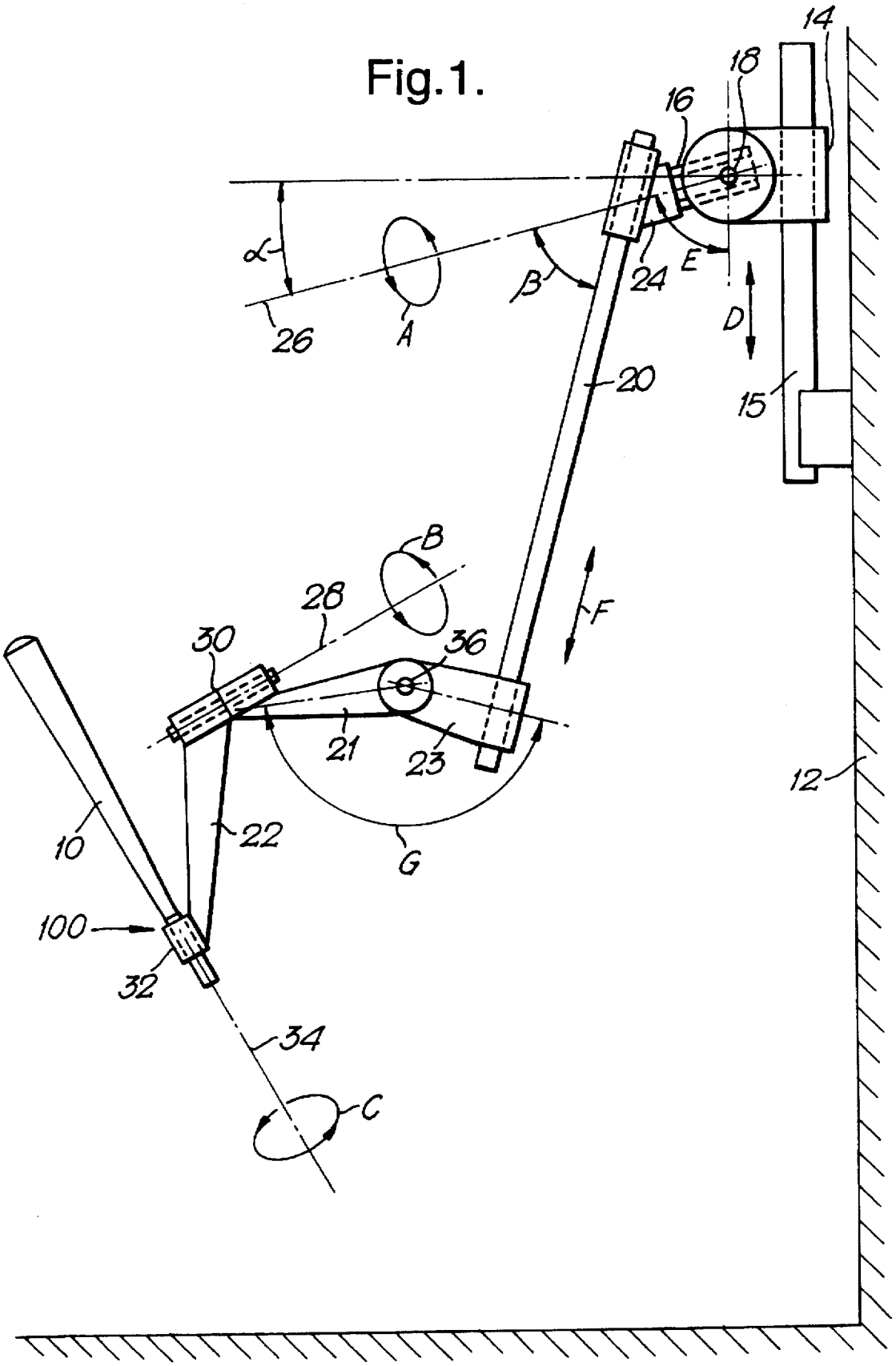
FIG. 1 is a diagrammatic side view showing a general disposition of parts in a golf swing simulation device.
Figure 2:
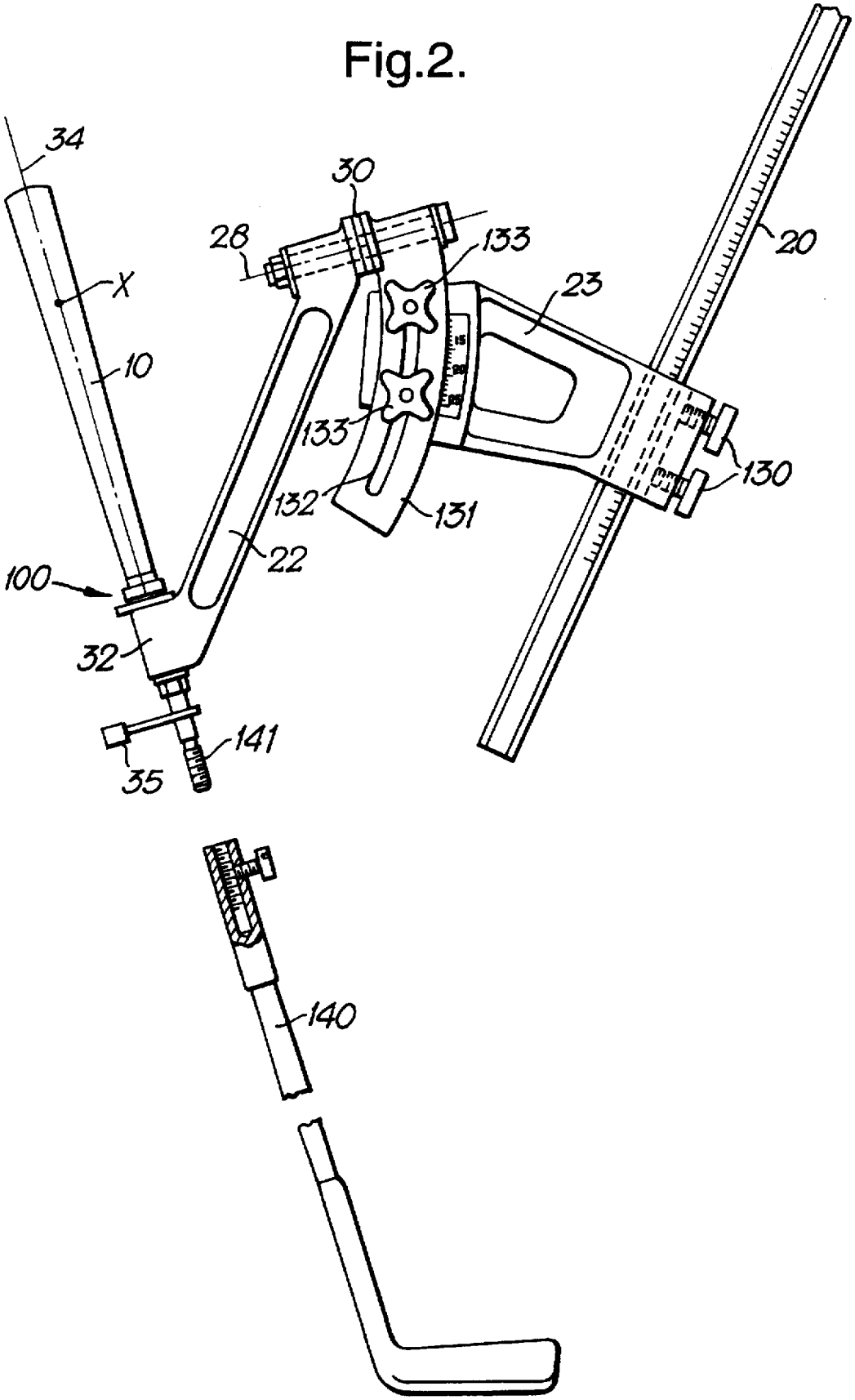
FIG. 2 is a more detailed side view of a handle region of the device, with some modifications.

FIGS. 1 and 2, from my GB-A-2039221 and GB-A-2081107 (the contents of which are hereby incorporated by reference), disclose a complete simulator device in which my new concepts can be implemented.

A golf simulator device has a handle 10 representing that of a golf club, an attachment 14 vertically adjustably mounted to a slide 15 to be fixed to a wall, and an angularly adjustable part 16 mounted to the bracket 14 about a horizontal pin 18 which extends parallel to the wall.

The angularly adjustable part 16 is linked to the handle 10 by an arm 20 and a pivoted crank 23,22 having a handle connector 32. The head 24 of the arm 20 is journalled to the part 16 to rotate about an axis 26 making an angle $\alpha$ with the horizontal, adjustable at the pivot 18. The other end of the arm 20 is connected to an inner link 23 of the crank. The inner link is connected to an outer link 22 at a pivot 30 allowing free rotation about an axis 28. The outer link 22 is journalled at 32 to the lower end of the handle 10 so that the handle 10 is rotatable relative to the link 22 about its own longitudinal axis 34.

The crank has an angle adjuster, provided in the FIG. 1 version by an extra element 21 connected in the inner link at an adjustment pivot 36.

This provides three rotational modes A,B,C about the axes 26,28 and 34 respectively, and four adjustments D,E,F,G at the slide 15, the pivot 18, in the effective length of the arm 20 and at the pivot 36. The basic swing is provided by rotational mode A, cocking of the hands is provided for by rotational mode B, and rotation of the handle about its own axis during the swing by rotational mode C.

FIG. 2 shows an improved crank angle adjustment as in GB-A-2081107. The inner link 23 is connected to the pivot 30 through an arcuate guide plate element 131. The plate element 131 has an arcuate slot 132 clamped adjustably by means of adjustment screws 133 to the inner link 23, which itself is longitudinally adjustably mounted on the free end portion of the arm 20 by clamping screws 130. The arcuate slot 132 provides a curve of adjustment of the crank angle centred at a point X lying on the handle, enabling the lie angle of the handle 10 to be adjusted without upsetting the geometry elsewhere.

A club shaft 140 with a head and/or a direction indicator 35 may be fitted to the projecting handle stem 141.

Figure 3:
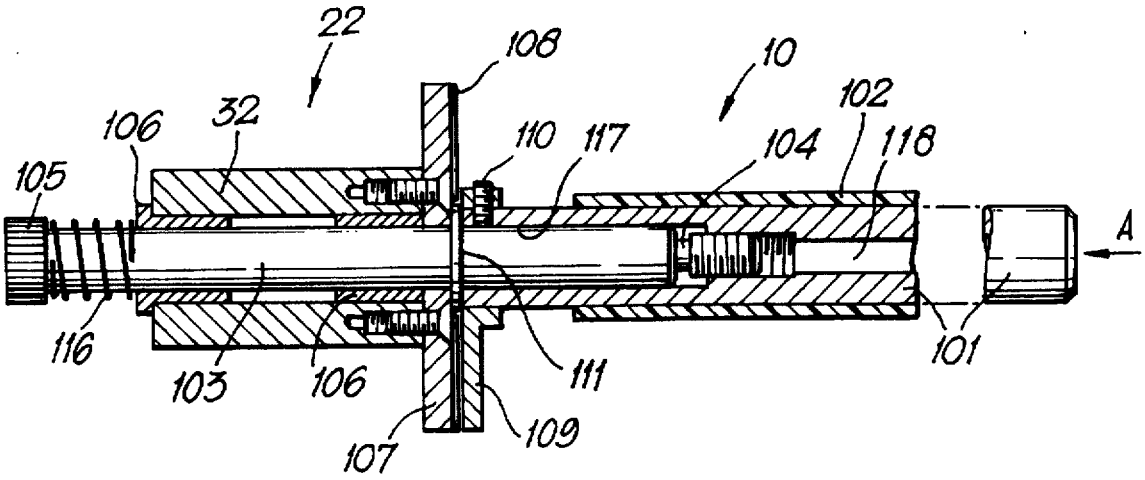
FIG. 3 is an axial cross-section through a handle arrangement at III—III of FIG. 4.
Figure 4:
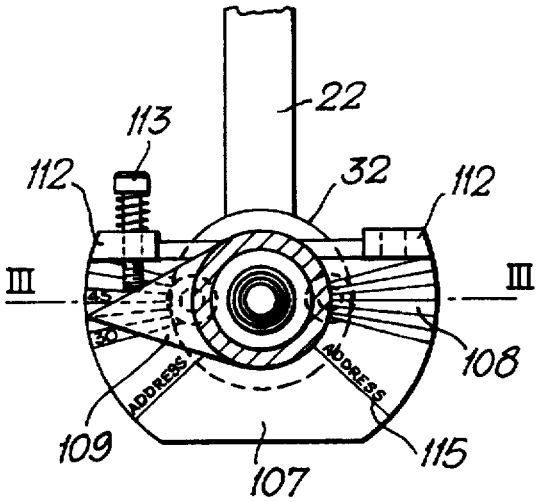
FIG. 4 is an end view of the handle arrangement, along the arrow "A" of FIG. 3.
Figure 5:
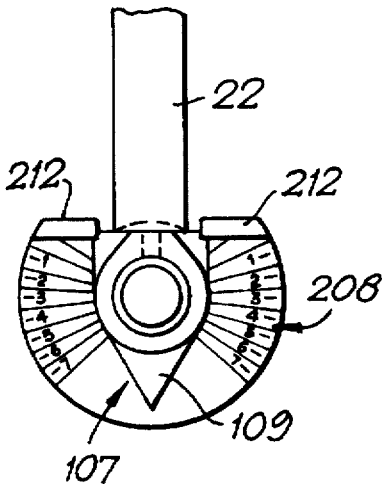
FIG. 5 is a corresponding end view of a second version of handle arrangement.

FIGS. 3, 4 and 5 show rotation monitor arrangements 100 embodying the concept now put forward, and used in combination with the FIG. 1/FIG. 2 device.

A handle assembly 10 has a straight rigid round bar 101, surrounded by a grip layer 102 which here is a conventional rubber golf club grip. The bar 101 is connected to the outer end of the crank so as to be rotatable about its own axis. This connection uses a sleeve 32 at the end of the link 22, with a pin 103 journalled rotatably in the sleeve by bearing bushes. The pin's head 105 traps it in the sleeve and is urged outwardly by a spring 116. The other end of the pin 103 fits into a mouth bore 117 of the bar 101 and has a screw portion 104 which fixes into a smaller inner bore 118.

A positional visual index is provided on the upper face of the crank sleeve 32, facing along the handle. The pin 103 projects through this, with a thrust washer 111 against the end of the bar 101 to assure, with the pin spring 116, restrained rotatability of the bar 101 around its own axis.

In this embodiment the positional index is on a metal plate 107 screwed onto the face of the sleeve 32, and having left- and right-hand limit or stop lugs 112 projecting up at one edge as seen in FIG. 4. A scale 108 provided on the face of the index plate 107, e.g. as an adhered transparency, shows on its left and right sides an "ADDRESS" marker 115 and graduations between the address marker and the respective limit lug 112. A limit adjustment screw 113 in a threaded through-hole of the lug 112 is adjustable to project out to a varying degree across the face of the plate 107.

A radial finger 109 is fixed on the end of the bar 101, as a separate metal component slid on the bar and secured by bonding and a securing pin or screw 110. The finger 109 can serve one or both of two functions. A first is as a pointer to indicate on the scale 108 the rotational position of the handle 10 relative to the link 22. The second function is as a stop component cooperating with the lug 112 or its limit adjustment screw 113. The lug 112 or its adjustment screw 113 define a stop position beyond which the grip 10 cannot rotate.

The left- and right-hand scales and lugs are of course to enable use by both right- and left-handed users.

To assemble this handle device onto a simulator mechanism the grip 102 is fitted on the bar 101 and the finger 109 secured to the bar end. The plate 107 with its scale is fitted on the crank sleeve 32 and the pin 103 slid through the sleeve from the other side, with the bearings 106 in place and through the thrust washer 111, into the mouth 117 of the bar 101 to fix it in place. The screw portion 104 may be bonded into its thread.

The user lines up the finger 109 with the "ADDRESS" marker 115 on the scale 108 (the mild friction established by the spring 116 helps maintain this position initially), before each practice swing. For each user, a particular angle of rotation corresponds to a desired hand position at the top of the backswing and the limit screw 113 is adjusted accordingly. The adjusted lug 112 then prevents rotation past that position in use and therefore schools the user's movements in the grip-rotational respect as well as in the swing. The monitoring interaction prevents excessive rotation and may also signal to the user that the desired rotation has been achieved.

It will be appreciated that the type of scale shown, and the lug/finger engagement used, are just single examples among many possibilities.

FIG. 5 shows a simpler and potentially more robust construction using a plain lug 212, without an adjuster screw, providing instead a selectable start position using appropriate scale markings 208.

Note that it is also possible to provide the monitor components separately and adapt the handle assembly of an existing simulator to achieve the same effect. A kit of handle assembly components for incorporating such a monitor arrangement, as well as a method of doing that, are independent aspects herein.

The reader will appreciate from the foregoing that the broad concept taught here is susceptible to wide variation based on the information now given, and the scope of the invention is not to be limited to details of the preferred examples described above.

I claim:

1. Golf swing simulation apparatus for guiding a simulated golf swing including an address and a backswing, comprising a handle portion defining a grip axis, a mechanical swing-guiding linkage having a handle connector at which it is connected to the handle portion, so as to permit rotation of the handle portion relative to said linkage about the grip axis, and a mounting arrangement to mount the mechanical linkage on a stationary support;

said linkage being constructed to guide movement of the handle portion in a predetermined swing arc relative to the mounting arrangement, and the handle portion and handle connector providing a grip rotation monitoring arrangement comprising a first engagement member on the handle portion radially overlapping with a second engagement member fixed on the handle connector so as to act as a stop abutment for the first engagement member, preventing said rotation of the handle portion about its grip axis during the backswing past a predetermined stop position corresponding to a predetermined angle of such rotation from a predetermined start position corresponding to the address.

2. Apparatus according to claim 1 in which the grip rotation monitoring arrangement comprises an adjuster to adjust the predetermined stop position.

3. Apparatus according to claim 1 in which the first engagement member is a radially-projecting member fixed to rotate with the handle portion and the second engagement member is a stop abutment positioned on the handle connector for abutting engagement with the radially-projecting member to determine the stop position.

4. Apparatus according to claim 3, comprising an indicator giving a visual indication of a rotational alignment of the handle portion relative to the handle connector.

5. Apparatus according to claim 3, in which the handle connector has left- and right-handed stop lugs to provide a respective said stop abutment for both senses of rotation of the handle portion, and a graded scale to indicate the rotational alignment of the handle portion's projecting member relative to the handle connector for both said left- and right-handed stop lugs.

6. Apparatus according to claim 1 comprising an indicator giving a visual indication of the relative rotational alignment of the handle portion and the handle connector.

7. Apparatus according to claim 6 in which the indicator comprises a graded scale on one of the handle portion and handle connector and a marker on the other to indicate said alignment on said scale.

8. Apparatus according to claim 6 in which the indicator has a positional index defining an address alignment for the start of the simulated swing.

9. Apparatus according to claim 1 in which the mechanical swing-guiding linkage comprises an elongate arm connected at one end to the mounting arrangement to pivot about a first axis adjacent the mounting arrangement, whereby the other end of the arm moves in a circular arc around said first axis during the simulated swing;

a crank having an inner end fixed to said other end of the elongate arm, an outer end having the handle connector, and a crank pivot between said inner and outer ends of the crank defining a second axis which is spaced from said first axis and about which the handle portion is rotatable relative to the elongate arm during the simulated swing to accommodate flexing of a user's wrists.

10. Apparatus according to claim 10 comprising an angularly adjustable connection of said one end of the elongate arm to the mounting arrangement, for adjusting the angle between the elongate arm and said first axis, and a crank angle adjuster in said crank for adjusting the angle between the elongate arm and said second axis.

11. Apparatus according to claim 10 in which the crank angle adjuster comprises an arcuate guide plate element connected adjustably to said inner end of the crank to provide a crank angle adjustment curve centered at a point on the handle portion.

12. Golf swing simulation apparatus for guiding a simulated golf swing including an address and a backswing, comprising a handle portion defining a grip axis;

a mechanical swing-guiding linkage having a handle connector connected to the handle portion so as to permit rotation of the handle portion relative to said linkage about the grip axis, and a mounting arrangement for mounting the said linkage on a stationary support;

said linkage being constructed to guide movement of the handle portion in a predetermined swing arc relative to the mounting arrangement, and further comprising an elongate arm connected at one end to the mounting arrangement to pivot about a first axis adjacent the mounting arrangement whereby the other end of the arm moves in a circular arc around said first axis during the simulated swing, and a crank having an inner end fixed to said other end of the elongate arm, an outer end having the handle connector and a crank pivot between said inner and outer ends of the crank defining a second axis spaced from the first axis and about which the handle portion is rotatable relative to the elongate arm during the simulated swing to accommodate the flexing of a user's wrists;

the handle portion and handle connector providing a grip rotation monitoring arrangement comprising a first engagement member on the handle portion radially overlapping with a second engagement member which is fixed on the handle connector to act as a stop abutment for the first engagement member, preventing any rotation of the handle portion about its grip axis in the backswing past a predetermined stop position corresponding to a predetermined angle of such rotation relative to a predetermined start position corresponding to the address.

13. Apparatus according to claim 12, comprising an angularly adjustable connection of said one end of the elongate arm to the mounting arrangement, for adjusting the angle between the elongate arm and said first axis, and a crank adjuster in said crank for adjusting the angle between the elongate arm and said second axis.

14. Apparatus according to claim 13, in which the crank angle adjuster comprises an arcuate guide plate element connected adjustably to said inner end of the crank to provide a crank angle adjustment curve centered at a point on the handle portion.

15. Apparatus according to claim 12, in which the first engagement member is a radially-projecting member fixed to rotate with the handle portion and the second engagement member is a stop abutment positioned on the handle connector for abutting engagement with the radially-projecting member to determine the stop position.

16. Apparatus according to claim 15, comprising an indicator giving a visual indication of the rotational alignment of the handle portion relative to the handle connector.

17. Apparatus according to claim 15, in which the handle connector has left- and right-handed stop lugs to provide respective said stop abutments for both senses of rotation of the handle portion, and a graded scale to indicate the rotational alignment of the handle portion's projecting member relative to the handle connector for both said left- and right-handed stop.

* * * * *

UNITED STATES PATENT AND TRADEMARK OFFICE

CERTIFICATE OF CORRECTION

PATENT NO. : 5,711,717

DATED : January 27, 1998

INVENTOR(S) : Ralph Henry Arthur Richards

It is certified that error appears in the above-identified patent and that said Letters Patent is hereby corrected as shown below:

On the face of the patent, under Foreign Application Priority Data, "9503388" should be --9503388.2--.

Under References Cited, U.S. PATENT DOCUMENTS, please add the following references:

| | | |
|---|---|---|
| 1,500,183 | 7/1924 | Dall |
| 1,983,920 | 12/1934 | Perin |
| 2,299,781 | 10/1942 | Adams |
| 2,458,932 | 1/1949 | Cottingham |
| 2,472,065 | 6/1949 | Cottingham |
| 3,319,963 | 5/1967 | Cockburn |
| 3,415,523 | 12/1968 | Boldt |
| 3,876,212 | 4/1975 | Oppenheimer |

Under References Cited, please add the following:

FOREIGN PATENT DOCUMENTS

| | | |
|---|---|---|
| 587,140 | 4/1947 | United Kingdom |
| 597,706 | 2/1948 | United Kingdom |
| 597,724 | 2/1948 | United Kingdom |
| 1,009,090 | 11/1965 | United Kingdom |
| 1,104,085 | 2/1968 | United Kingdom |
| 1,104,203 | 2/1968 | United Kingdom |
| 1,144,180 | 3/1969 | United Kingdom |
| 1,258,018 | 12/1971 | United Kingdom |
| 51-34047 | 1976 | Japan |
| 1,500,322 | 2/1978 | United Kingdom |
| 2,039,221 | 8/1990 | United Kingdom |
| 2,081,107 | 2/1982 | United Kingdom |
| 2,175,809 | 12/1986 | United Kingdom |

UNITED STATES PATENT AND TRADEMARK OFFICE

CERTIFICATE OF CORRECTION

PATENT NO. : 5,711,717

DATED : January 27, 1998

INVENTOR(S) : Ralph Henry Arthur Richards

It is certified that error appears in the above-identified patent and that said Letters Patent is hereby corrected as shown below:

Col. 1, line 18, "piloted" should be --pivoted--.

Col. 5, line 22, in claim 10, "claim 10" should be --claim 9--.

Col. 6, line 48, in claim 17, after "stop" insert --lugs--.

Signed and Sealed this

Sixth Day of October, 1998

*Attest:*

*Attesting Officer*

Bruce Lehman

BRUCE LEHMAN

*Commissioner of Patents and Trademarks*